United States Patent [19]

Kurz et al.

[11] Patent Number: 4,948,060

[45] Date of Patent: Aug. 14, 1990

[54] AUTOMATIC WEB ROLL HANDLING SYSTEM FOR SPLICING

[75] Inventors: Robert S. Kurz, Franklin; Alexander Jesensky, Hopkinton; Raymond W. Johnson, Norfolk; Tamas Hetenyi, Concord; Geoffrey C. Grigg, Milford; Stephen C. Dangel, Bedford; John W. Clifford, Ashland; Richard A. Butler, Jr., Marion, all of Mass.

[73] Assignee: Butler Automatic, Inc., Canton, Mass.

[21] Appl. No.: 243,521

[22] Filed: Sep. 12, 1988

[51] Int. Cl.[5] ..... B65H 19/12

[52] U.S. Cl. ..... 242/58.1; 242/58.6; 414/222; 414/495; 414/911

[58] Field of Search ..... 242/58.6, 58.1–58.4, 242/79; 414/911, 495, 222

[56] References Cited

U.S. PATENT DOCUMENTS

| | | | |
|---|---|---|---|
| 3,253,795 | 5/1966 | Penrod et al. | 242/58.2 |
| 3,448,941 | 6/1969 | Dickerson | 242/79 |
| 3,690,583 | 9/1972 | Herman | 242/79 X |
| 3,695,539 | 10/1972 | Lindstaedt | 242/58.6 |
| 4,131,206 | 12/1978 | Kawada et al. | 414/911 X |
| 4,819,758 | 4/1989 | Greene et al. | 414/911 X |

FOREIGN PATENT DOCUMENTS

| | | | |
|---|---|---|---|
| 1940426 | 6/1973 | Fed. Rep. of Germany | 242/79 |
| 1206332 | 2/1960 | France | 242/58.6 |

*Primary Examiner*—John M. Jillions

*Attorney, Agent, or Firm*—Nutter, McClennen & Fish

[57] ABSTRACT

A web roll handling system comprises a roll loading section, a plurality of splicers and at least one robotic vehicle arranged to travel back and forth between the loading section and the plurality of splicers.

11 Claims, 5 Drawing Sheets

AUTOMATIC WEB ROLL HANDLING SYSTEM FOR SPLICING

This invention relates to a system for handling webs such as paper and cloth. It relates more specifically to a system for automatically loading large rolls of such webs into a splicer so that web can proceed uninterruptedly to a web consuming machine downstream from the splicer.

BACKGROUND OF THE INVENTION

The proper handling of webs is of importance in many industries, particularly in the printing industry. Today's high speed printing presses print on web drawn from a roll mounted on the roll support arms of a roll stand located upstream from the printing press. In order to avoid having to shut down the press each time a web roll expires, a splicing mechanism is invariably incorporated into the roll stand to enable the trailing end of the expiring web to be spliced to the leading end of the web on a fresh or full-sized web roll. Also, a web accumulator or festoon is typically located between the splicer and the press so that the web being drawn from the expiring roll can be slowed down or stopped during the splicing operation, with the printing press drawing its web requirements from the accumulator at line speed so that there is no interruption or delay in printing. After the splicing operation is completed, the accumulator is replenished with web drawn from the new roll so that there will be enough web available in the accumulator to supply the needs of the printing press when the next splicing operation occurs upon expiration of the new web roll.

As printing speeds become higher and higher, it is obvious that more and more paper is required to meet the needs of the press. These demands can be met by making the web rolls larger or by changing the rolls more frequently. Actually, some of today's high speed presses consume paper and other webs so fast, e.g. in excess of 2000 ft. per minute, that both of these solutions are required to be used. The rolls serving such presses can be as large as 8 ft. in diameter and weigh as much as 6,000 lbs. or more. It is obvious, then, that the efficient handling of these large and heavy web rolls is a prerequisite to an efficient printing operation.

In practice, however, improvements in the handling of web rolls have not kept pace with the operational advances in presses and other web-consuming machines. Indeed, it is difficult to automate the handling of such rolls because the rolls have variable tapers, eccentricities, weight imbalances and other irregularities which make it difficult to precisely control the positions of the rolls for proper loading into the splicers. Resultantly, web rolls are still hoisted onto small trucks and hauled to the web splicers where they are hoisted into place on the roll support arms of the splicers. Also, the leading edges of the webs are prepared for the next splicing operation right at the splicers. Typically, this is a fairly time-consuming procedure involving squaring off the web leading edge, applying double-faced adhesive tape to that edge, and taping the edge to the outside of the roll or to a preparation bar in the splicer. Bearing in mind that a large printing operation may have many presses running simultaneously, each with its own upstream splicer, it is apparent that large amounts of manpower and equipment are required just to service the splicers to keep the presses supplied with paper to print on.

Also, the splicers themselves have not kept pace with today's presses and other high-speed web consuming machines. Some of them require that a roll be mounted to the roll support arms of the splicer by way of a roll shaft. The requirement for the shaft complicates the loading of the web roll on the splicer. Also, those shafts able to support the heavier and wider web rolls in use today, are often not perfectly concentric. Resultantly, at high press speeds, even a small shaft eccentricity or irregularity can cause tension upsets in the web which can result in tearing and breaking of the web, necessitating a complete shutdown of the downstream press or other web-consuming machine.

Other contemporary splicers have arms which support the web roll by way of chucks which project into the opposite ends of the roll core. These have the advantage of easy loading and they do not require a shaft extending through the roll. However, they usually splice the web on the fly. For many webs, particularly the wider ones, better and more reliable splices are made when the webs being spliced are stationary at the time of splicing.

Accordingly, it would be highly desirable if there were available a system for handling web rolls so that the rolls supplying all of the splicers in a given facility could all be prepared for splicing at a single roll preparation area and be transported from that area automatically to those splicers of that facility then in need of more paper or web and be loaded automatically into the respective splicers with their web leading edges in position for splicing with splicing taking place automatically to satisfy the web requirements of the presses or other web-consuming machines served by those splicers.

Accordingly, the present invention aims to provide an automatic web roll handling system for servicing splicers, especially those which splice at zero speed.

Another object of the invention is to provide a system for transporting large and heavy web rolls automatically from a single roll preparation area to selected splicers in a group of splicers on a demand basis.

Another object is to provide such a system which permits all roll preparation to be performed at a single preparation area remote from the splicers with the rolls then being transported automatically to the splicers on a demand basis and loaded onto the respective splicers and the webs on the rolls then being spliced to the running webs in those splicers all without any human intervention or control.

A further object of the invention is to provide an improved guided vehicle for transporting a large and heavy web roll between a roll preparation area and a splicer.

A further object of the invention is to provide such a vehicle which automatically positions its supported web roll with respect to the roll support arms of the destination splicer.

Still another object of the invention is to provide a guided transport vehicle of this type which is safe to use in a personnel work area.

A further object of the invention is to provide a turret splicer for use with a guided roll transport vehicle which can splice the web drawn from a roll taken from the vehicle at zero speed.

Other objects will in part be obvious and will in part appear hereinafter. The invention accordingly comprises the features of construction, combination of elements, and arrangement of parts which will be exemplified in the following detailed description, and the scope of the invention will be indicated in the claims.

SUMMARY OF THE INVENTION

In general, our system is for use primarily in a facility that consumes large amounts of web from rolls. A printing house is a good example of such a facility and we will describe the invention in this context.

A typical printing house has a large number of presses distributed over the floor area with associated splicers that provide paper webs uninterruptedly to the presses. The facility usually also has a roll preparation or staging area where incoming rolls of web are stored and from which they are transported as needed to the various splicers.

The present system has three parts or sections, namely, a single roll loading section located at the roll preparation area, a splicer located adjacent to each one of the presses in the printing facility and at least one guided transport vehicle which accepts rolls from the loading section in the preparation area and transports those rolls on demand to the various splicers for automatic loading onto the splicers. While each of these system sections operates more or less independently of the others, their actions are coordinated by a central processor so that rolls already prepared for splicing in the preparation area are transported on an as-needed basis to the splicers in the facility being served by the system and loaded onto the splicers and readied for splicing all without any human intervention.

The loading section comprises a special inclined plane lift which, without any ancillary hoists or other variable lifting mechanisms, transports web rolls from a storage rack to a loading position that places the centerline of the roll at a precisely defined orientation and elevation above a loading station on the floor.

When the roll reaches the loading station, one of the guided vehicles of the system is commanded to move from a parking area to the loading station directly below the roll so that its centerline is parallel to the centerline of the roll. Each vehicle includes a lift table that is longitudinally split to divide the table into two separate sections each of which can be elevated independently of the other and each of which pivotally supports special arcuate roll support members to be described in more detail later. When the vehicle is positioned under the roll, the table sections are elevated independently causing their support members to engage around the underside of the roll until each table section supports the weight of the half of the roll directly above it. Then the loading section releases the roll to the vehicle. In this way, the transferring of the roll from the loading section to the vehicle is accomplished without any shift or movement whatsoever of the centerline of the roll with respect to the loading station.

After the roll is loaded onto the vehicle, the vehicle, under the control of the central controller is caused to follow a preprogrammed path along the floor of the facility to a selected turret splicer in the facility which has been determined by the controller to require a web roll refill. When the vehicle reaches that destination splicer, it stops and communicates with that splicer electronically so that the splicer is apprised that a new roll is available and the vehicle is apprised that the splicer is ready to receive that roll. Then the vehicle advances to a roll loading station in front of the splicer.

When the vehicle reaches that station, the web roll supported thereby will automatically be in alignment with the roll supporting turret arms of the splicer so that when the arms are moved to their roll loading positions and spread apart to receive the new roll, their chucks will be in perfect alignment with the opposite ends of the roll core so that the roll can be loaded automatically into the splicer. In other words, in accordance with the invention, the elevation of the centerline of a roll at the loading station in the roll preparation area is made exactly the same as the elevation of the splicer chucks above the floor in the loading station in front of the splicer when the turret arms are in their loading positions. This means that when the vehicle positions any roll in front of the splicer, the opposite ends of roll core will assuredly be at exactly the proper positions to receive the splicer chucks when the turret arms are drawn together to engage the opposite ends of the roll. Thus, by maintaining close control over the positions of the roll centerline at the roll preparation area loading station and at the splicer loading station, the need for complex electronic sensing and positioning mechanisms to position the roll with respect to the splicer chucks is avoided even though the floor of the facility may contain many bumps and undulations between the preparation area and the splicer. Consequently, the system achieves maximum roll loading reliability at minimum cost.

In accordance with the foregoing then, before the expiration of the running web roll on a given splicer, a fresh web roll is positioned by the vehicle directly in front of that splicer. When that expiring web roll reaches a predetermined diameter (e.g. ten minutes to expiration), the new roll is picked up off the vehicle by the splicer turret arms and swung to a splicing position in the splicer, with the roll being rotated to position the already prepared leading edge of the web on that roll at the proper position for splicing. Then, when the expiring roll reaches a predetermined minimum diameter, the splicer is caused to commence a splice sequence. In accordance with this sequence, the expiring roll is braked to a stop or to a selected minimum speed. Then the splicer's splicing mechanism is actuated to press the trailing end of the expiring web into engagement with the prepared leading end of a full web roll just mounted on the splicer turret. That splicing mechanism then severs the trailing end of the expiring web just downstream from the splice and the new roll is accelerated rapidly to gradually bring the speed of the web drawn from the new roll up to the speed of the downstream web consuming machine at which point the splicing sequence is completed. For the duration of the splice sequence, the web-consuming machine draws its web requirements from the web accumulator located between the machine and the splicer. Actually, during the aforesaid roll acceleration step of the splice sequence, the new roll is accelerated so that the speed of the web from the new roll actually exceeds line speed for a time in order to refill the web accumulator so that it will have sufficient web storage to accommodate the next splice sequence.

Before a new web roll can be picked up by the splicer turret arms, the spent roll core thereon must first be released from the turret arms and removed from the vicinity of the splicer. To accomplish this, a core clamping arm is mounted at the front of the splicer near the bottom thereof. Just before the turret rotates to pick up a new web roll from the guided vehicle in front of the splicer, this arm swings up and clamps around the core. The turret arms are then spread apart to disengage the chucks from the ends of the spent core and to ready the arms to receive the new roll. The clamping arm then swings down and deposits the spent core in a tray conveniently mounted to the side of the guided vehicle. Since the core usually carries a short web tail, preferably means are provided for rotating the core to wind up that tail on the core before the core is deposited in the tray.

As soon as the new web roll is lifted from the guided vehicle by the splicer turret, that fact is sensed by the central controller which controls the vehicle to cause it to return to the roll preparation area of the facility so that the empty roll core can be removed from its tray and a new web roll deposited onto the vehicle as described above. That vehicle may then be controlled to bring this fresh roll to the same splicer or to a different splicer depending upon the needs and demands of the various splicers in the printing facility.

The guided vehicle section of the system is specifically designed to achieve maximum reliability in the handling and loading of the heavy web rolls at minimum cost and to present a minimum hazard to personnel working in the vicinity of the splicers and presses. The vehicle is driven automatically by a rechargeable battery-powered electric motor under the control of the system controller. The vehicle includes sensors which detect wires embedded in the floor of the facility that define the various vehicle paths between the roll preparation area and the various splicers. At locations where the various paths branch or intersect, digital codes are embedded in the floor using magnets or wire loops which are sensed by sensors on the vehicle. The vehicle follows one or another of these paths depending upon the instructions from the system controller.

The vehicle has three wheels, namely, a pair of rear follower wheels and a single steerable driven front wheel, the front wheel being controlled to follow the path wires. A pair of outrigger casters are positioned outboard of the front wheel to prevent the loaded vehicle from tipping in the event that it runs over a small obstacle on the floor, such as a piece of wood. Actually, as will be described in more detail later, the vehicle is so stable under load that even if it tips, the centerline of the roll on the vehicle does not shift relative to the vehicle to the extent that it would be misaligned with the splicer chucks when the roll reaches the loading station in front of its destination splicer.

The vehicle also includes an array of ultrasonic sensors at the front of the vehicle which detect obstacles in the path of the vehicle. The vehicle controller responds to the output from the sensors to stop the vehicle before the vehicle can bump into such obstacles. Also, as a safety backup, an impact sensing bumper is mounted to the front and sides of the vehicle which, upon engagement with an obstacle such as a person, causes the vehicle to be braked to a stop before the vehicle itself can strike that obstacle. In other words, that bumper is spaced far enough in front of the vehicle and the braking system operates sufficiently quickly that when an obstacle is sensed by the bumper, the vehicle is braked to a stop in the time that it takes the vehicle itself to reach that obstacle.

As alluded to above, one of the main objectives of the vehicle portion of the preset system is to maintain the position of the web roll centerline so that the position of the centerline is exactly the same when the roll is loaded on the vehicle at the roll preparation area and when the roll is positioned for loading onto the turret arms of the splicer. This is achieved by incorporating into the vehicle a special split lift table which engages under and assumes support of the roll in such a way as to hold that centerline position for all rolls loaded onto the vehicle even though those rolls may be eccentric, tapered, or have other irregularities which effect the weight distributions of the rolls. As will be described in detail later, the split table is arranged to engage and support the web roll being transferred to it at the roll preparation area under the control of a special dual load sensing arrangement so that the roll center line of each loaded roll is at exactly the same location no matter how the outer contours or weights of the rolls may vary from roll to roll.

Thus the guided vehicle portion of the present system contributes in large part to the overall reliability, efficiency and economics of the system as a whole. Yet the cost of the vehicle is comparable to the cost of conventional robotic or guided vehicles of this general type that do not have the advantages described above and which, therefore, could not contribute to an effective reliable low cost overall system for handling web rolls and other similar heavy objects that require precise positioning for use.

BRIEF DESCRIPTION OF THE DRAWINGS

For a fuller understanding of the nature and objects of the invention, reference should be had to the following detailed description, taken in connection with the accompanying drawings which.

DESCRIPTION OF THE PREFERRED EMBODIMENT

Figure 1:
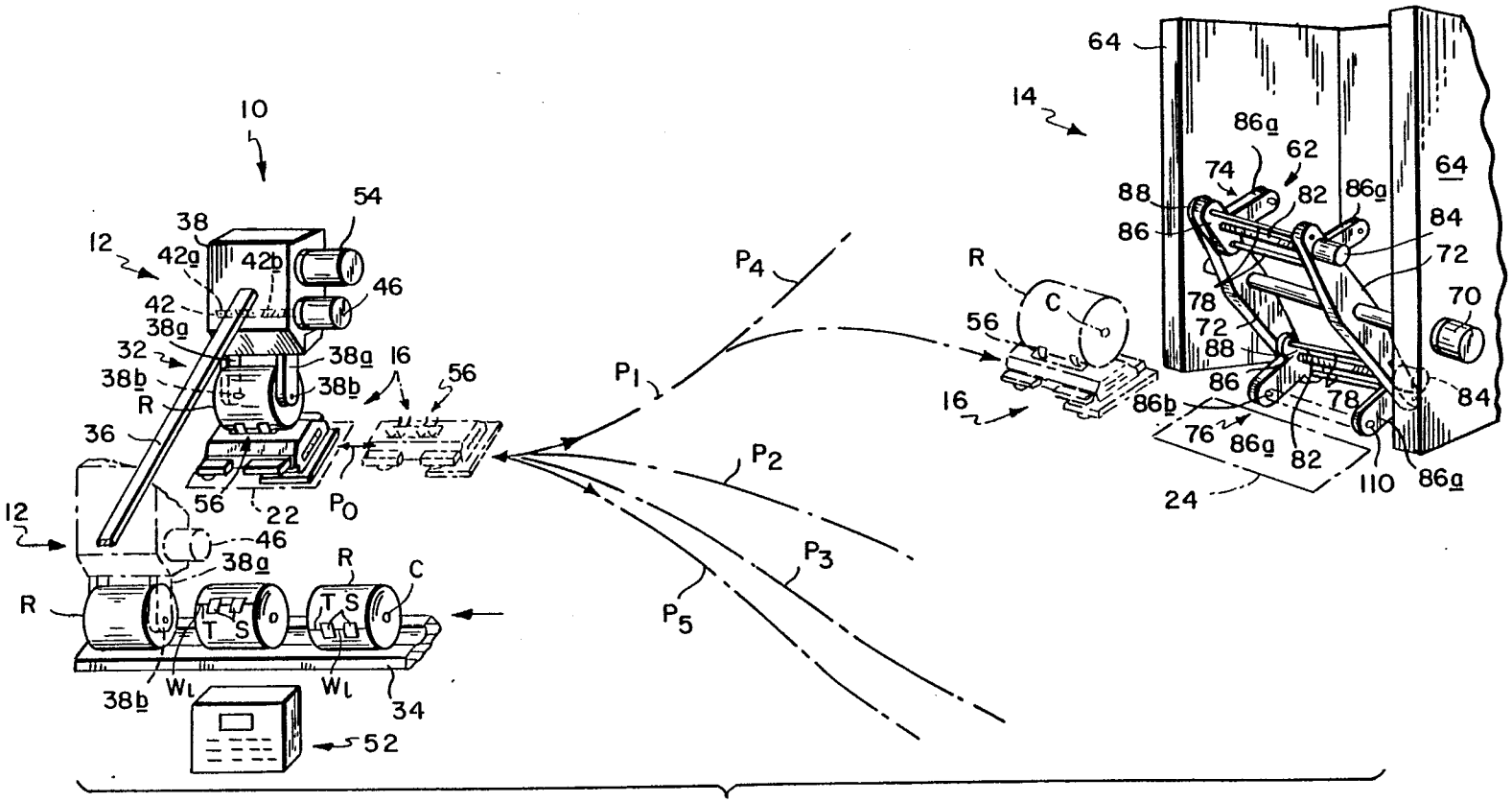
FIG. 1 is a schematic diagram of an automatic web roll handling system embodying the features of this invention.

Referring to FIG. 1 of the drawings, our system shown generally at 10 comprises a web roll loading section 12 usually located in a roll preparation area in the facility using the system, one or more splicers 14 positioned at various locations throughout the facility adjacent to the one or more printing presses or other web consuming machines which they are serving, and one or more automatic guided vehicles 16 which are arranged to shuttle back and forth between the loading section 12 and the various splicers 14 as needed to keep the splicers supplied with fresh web rolls to meet the web demands of the associated presses or other web consuming machines.

The vehicles 16 follow predetermined paths $P_0$ to $P_5$ extending between a loading station 22 in the preparation area and loading stations 24 in front of the various splicers 14. The paths $P_1$ to $P_3$ branch from the path $P_0$ leading from loading station 22 and they extend in various directions, the particular path layout depending upon the locations of the splicers 14 in the facility. Additional paths may branch from one or another of the paths $P_1$ to $P_3$, the path $P_4$ branching from $P_1$ being an example. Preferably at least one path $P_5$ branching from path $P_0$ is provided to park a plurality of guided vehicles 16 until they are needed.

While rolls R are on a floor rack 34, they are prepared for splicing by personnel in that area. The preparation involves removing the wrapper around the roll, cutting off a leading end segment of the web on the roll which is usually damaged for one reason or another, squaring off the leading edge $W_1$ of the web so that it has a perfectly straight edge, applying double-faced adhesive tape T to the web leading edge which is used to make a splice as will be described later and applying a few short adhesive strips or tabs S to the leading edge of the web on the roll at right angles to that edge to temporarily "tack" or hold the web edge to the remainder of the roll until the roll is used. Normally, most of the above web preparation steps are done manually at each splicer. One of the main advantages of the present system is that the system allows all of these preparation steps for the web rolls supplied to all of the splicers at the facility to be done right at the same roll preparation area; normally, no operating personnel whatsoever are required to be at the individual splicers 14.

For reasons to be described later, preferably the tape T or the strips S include material that is detectable to mark the location of the web leading edge $W_1$. For example, the strips S can be metallized or reflective so that they can be sensed by an optical sensor on splicer 14.

Figure 2:
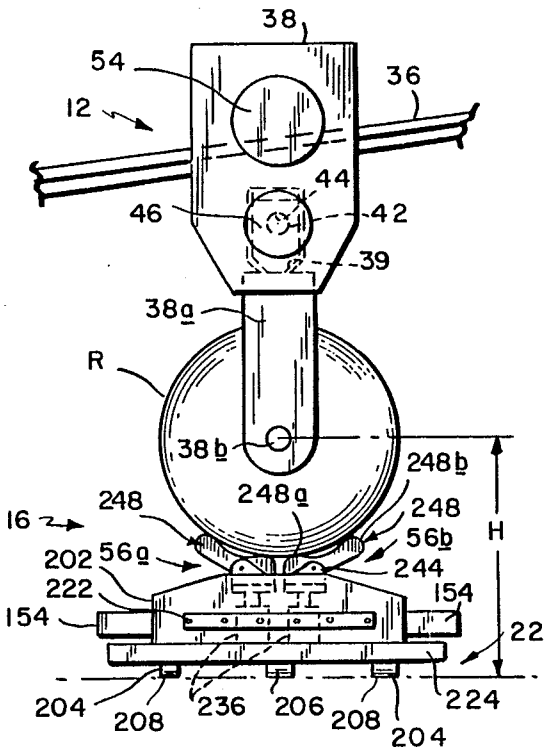
FIG. 2 is a front elevational view on a larger scale showing in greater detail the loading of a web roll onto the guided vehicle section of the FIG. 1 system.

Referring to FIGS. 1 and 2, loading section 12 comprises an inclined plane lift shown generally at 32 which is arranged to pick up web roll R from a supply of such rolls stored on a floor rack 34 and to transfer the roll to a guided vehicle 16 located at loading station 22. As we shall see, lift 32 transports each successive roll R from rack 34 to the location in space that places the roll core C and the roll centerline at exactly the same orientation and elevation above the floor at loading station 22. The lift 32 comprises an overhead upwardly inclined beam or rail 36 and a lifting carriage 38 which travels back and forth along beam 36. Carriage 38 supports a pair of spaced-apart dependent arms **38*a* whose upper ends extend into and are keyed to a channel 39 in the underside of carriage 38 as shown in FIG. 2 so that the arms can be moved toward and away from the transverse centerline of the carriage. Also, means are provided on the carriage for moving the arms toward and away from one another. In the illustrated lift 32, the arms are moved in this fashion by a lead screw 42 whose opposite end segments are threaded in opposite directions and thread into aligned correspondingly threaded openings 44 adjacent to the upper ends of arms 38*a*. One end of the shaft 42 is connected to the shaft of a servo motor 46 mounted to carriage 38, that motor being under the control of the system's central controller shown generally at 52 in FIG. 1**.

Another electric motor 54 mounted to carriage 38 is arranged to move the carriage back and forth along beam 36. For example, the motor 54 may rotate a gear (not shown) meshing with a rack (not shown) extending along beam 36. Motor 54 is also controlled by controller 52.

In order to load a web roll R onto a vehicle 16 at loading station 22, controller 52 operates motor 54 to cause carriage 38 to move into position over a roll R at the lefthand end of rack 34 so that the carriage arms **38*a* bracket the roll with the chucks 38*b* at the lower ends of those arms being disposed opposite the ends of the roll core C as shown in phantom in FIG. 1. Then controller 52 operates motor 46 to close carriage arms 38*a* so that the chucks engage core C. Next the controller operates motor 54 to move carriage 38 from its position over rack 34 to the position shown in solid lines in FIG. 1 which locates the roll core C at a precise orientation and elevation H above the floor at the loading station 22. As will be described later, that elevation H is exactly the same as the roll core elevation when the vehicle 16 is positioned at the loading station 24 in front of the splicer 14**.

As soon as the carriage 38 positions roll R above the loading station 22 as shown in solid lines in FIG. 1, a guided vehicle 16, having previously been moved from the parking track $P_5$ to a position in front of the loading station 22 as shown in phantom in FIG. 1, is moved by controller 52 to the loading station directly under the roll R suspended from carriage 38. When the vehicle 16 is in position at loading station 22, a special split lift table shown generally at 56 on the vehicle rises up and engages the roll R from below so that the full weight of the roll is assumed by the vehicle. This assumption by the vehicle of the full weight of the roll is sensed causing controller 52 to control motor 46 so as to spread apart the carriage arms **38*a* thereby releasing that roll R to the vehicle 16**.

Next, controller 52 directs vehicle 16 to move from loading station 22 along path $P_0$ and along one or another of the paths $P_1$ to $P_4$, to one or another of the splicers in the facility, e.g. splicer 14. When the guided vehicle 16 carrying a roll R reaches the designated splicer, it parks at a standby position just ahead of the splicer as shown in phantom in FIG. 1 until the roll R carried by that vehicle is ready to be loaded into the splicer 14.

The paths $P_1$ to $P_5$ followed by the guided vehicle 16 are defined by wires (not shown) embedded in the floor of the facility. The wires carry an electric current which is sensed by a sensor on each vehicle 16 causing that vehicle to follow the wire. At the locations where the vehicle paths $P_0$ to $P_5$ branch, path addresses in the form of embedded permanent magnets or wire loops are provided so that the vehicle 16 can follow a predetermined course under instructions from controller 52. Any one of a number of conventional means for guiding vehicle 16 may be used in the present system, and consequently, the guidance arrangement will not be described in detail. When vehicle 16 reaches its standby position shown in phantom in FIG. 1, it issues a signal to the splicer 14 indicating that fact. The splicer, in turn, communicates with the vehicle indicating its status and whether or not it is ready to receive a new web roll. If the splicer section 14 is ready to take on a new roll, it issues a ready signal to vehicle 16 which thereupon moves to the loading area 24 directly in front of the splicer.

As stated previously, when vehicle 16 is positioned at station 24, the elevation H above the floor of the core C of the roll on the vehicle is exactly the same as the elevation of that core when the roll was supported over loading station 22 by lift 32. Accordingly, the roll core has exactly the correct orientation and elevation to enable the roll to be loaded automatically into the splicer section 14.

It is important to appreciate that the supporting of the centerline or core of web roll R at an elevation H over the loading zone 22 in the web preparation area which is exactly the same as the core elevation H required in order to load the roll into splicer section 14 when that roll arrives at the loading zone 24 in front of the splicer and the engaging of the roll R from below by the special lift table on vehicle 16 enables the roll R to be loaded automatically into the splicer without the need for expensive, costly and complex sensing and control mechanisms for correctly positioning the web roll and even though the facility floor has bumps and undulations between the loading stations 22 and 24.

Figure 3:
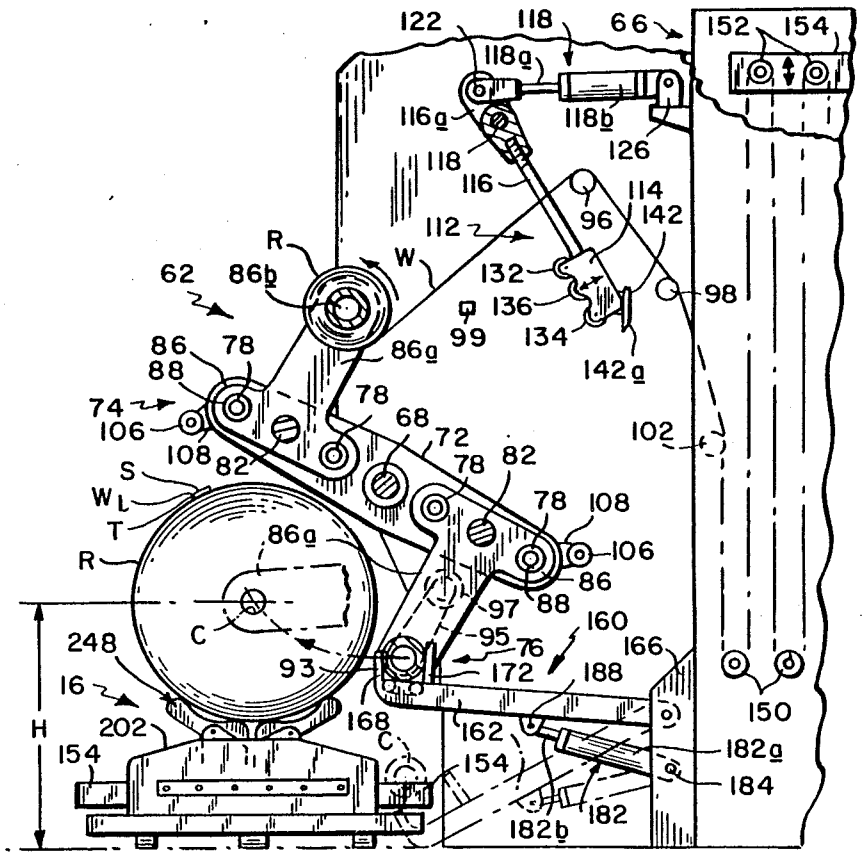
FIG. 3 is a similar view showing the positioning by that vehicle section in front of the splicer section of the FIG. 1 system.

Referring now to FIGS. 1 and 3, splicer 14 comprises a roll supporting turret shown generally at 62 mounted between a pair of spaced-apart load bearing side frames 64 and a web accumulator or festoon shown generally at 66 located behind turret 62. Turret 62 includes a heavy shaft 68 whose opposite ends are rotatively mounted to side frames 64. Supported on shaft 68 for rotation therewith are a pair of spaced-apart generally straight parallel roll support arms 72. Mounted to the opposite ends of arms 72 are a pair of substantially identical roll support sections or stations shown generally at 74 and 76. Each section 74, 76 includes a pair of parallel guide rods 78 spaced along the arms and whose opposite ends are mounted to the arms and a lead screw 82 positioned between the rods in parallel therewith and whose opposite ends are rotatively mounted to arms 72. Each lead screw 82 is rotated by the shaft of a reversible motor 84 mounted to the righthand arm 72 as viewed in FIG. 1.

Each roll support section 74, 76 also includes a pair of laterally spaced apart mirror-image chuck support members 86. Each of these members has a pair of lateral openings 88 for slidably receiving guide rods 78 and a threaded opening 92 for threadedly receiving the associated lead screw 82. Each lead screw 82 has a right-hand thread or twist along half of its length and a left-hand thread or twist along the other half of its length. Accordingly, when the lead screw 82 at each station 74, 76 is rotated in one direction by its motor 84, the chuck support members 86 at that section are drawn toward one another. Conversely, when that lead screw 82 is rotated in the opposite direction by its motor 84, the associated chuck support members 86 are spread apart. The operation of each step motor 84 is controlled by controller 52.

As shown in FIGS. 1 and 3, the chuck support members 86 at roll support section 74 include a pair of extensions **86*a* which extend rearwardly at right angles to arms 72 and a pair of collinear roll chucks 86*b* project from these extensions toward one another. The chuck support members 86 at roll support section 76 also include a pair of extensions 86*a* that support a pair of opposed colinear chucks 86*b*. In this case, however, the extensions 86*a* extend forwardly at right angles to arms 72. Each roll support section 74, 76 is arranged to support a full web roll R between the chuck support members 86 of that section, with the chucks 86*b*** engaging in the opposite ends of the core C of that web roll.

FIG. 3 shows a nearly depleted web roll R supported by the upper roll support section 74 of turret 62, the other section 76 of the turret being empty. The web W from that roll R is thus the running web serving the downstream web consuming machine (not shown). That running web W passes from roll R over guide rolls 96, 98 and 102 into the festoon 66 interposed between the splicer section and the web consuming machine. A guided vehicle 16 carrying a fresh roll R is positioned at the standby location in front of the splicer section 14 as shown in phantom in FIG. 1.

After the electronic information exchange between splicer section 14 and guided vehicle section 16 described previously regarding the presence of the fresh roll R at the standby position and the readiness of the splicer section 14 to receive the new roll, the guided vehicle 16 advances in accordance with preprogrammed instructions from controller 52 a precise distance from that standby position into the loading station 24, that distance or advance of the vehicle 16 depending upon the length of roll R which information will have previously been provided to controller 52. The objective is to position the longitudinal centerline of roll R midway between the two arms 72 of the splicer 14.

When the vehicle 16 is positioned at loading station 24, controller 52 controls the motor 84 of roll support section 76 to rotate the associated lead screw 82 to spread apart the chuck support members 86 so that the distance between the corresponding chucks **86*b* just exceeds the length of the roll core C. That distance between the chucks also depends upon the roll R length information loaded into controller 52** as aforesaid.

Splicer 14 includes conventional means for monitoring the diameter of the web roll R at each roll support section 74, 76, the sensor outputs being applied to controller 52. When the diameter of the running roll at section 74 reaches a selected value, yielding, say, a ten minute web supply, controller 52 causes the splicer 14 to execute a roll loading operation. More particularly, the controller actuates the motor 70 to rotate turret shaft 68 and arm 72 carried thereby clockwise as viewed in FIGS. 1 and 3 to a roll loading position shown in phantom in FIG. 3 that locates the chucks **86*b* of section 76 directly opposite the ends of the core C of the roll on vehicle 16 at loading station 24. As noted previously, the vehicle 16 will have supported and transported roll R so that when the vehicle reaches the loading station 24, the centerline of the roll, i.e. core C, will be positioned precisely at an elevation H above the floor that coincides with the elevation of chucks 86*b* when arms 72** have rotated to their roll loading position.

Next, controller 52 controls the motor 84 of roll support section 76 to rotate lead screw 82 to draw the chuck support members 86 there together until the chucks **86*b* engage in the opposite ends of core C. Again, this control depends upon the length of roll R previously programmed into controller 52**.

Figure 4:
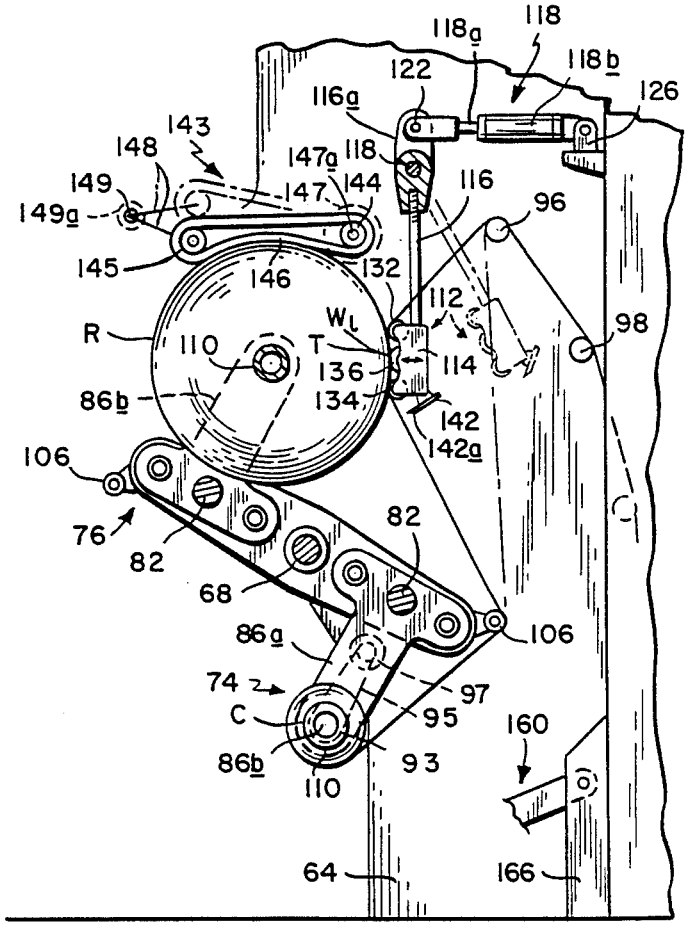
FIG. 4 is a similar view showing the splicer section after it has picked up a web roll from the vehicle section.

With the fresh roll R now mounted in the roll support section 76, controller 52 actuates motor 70 to rotate turret 62 clockwise to the position shown in FIG. 4 which lifts the fresh web roll R from vehicle 16 and positions it for splicing as shown in FIG. 4. Each chuck **86*b* includes a cogged pulley 93 connected by a endless belt 95 to the shaft of an electric motor 97 mounted to the adjacent carriage extension 86*a*. The chuck drive motors 97 at roll support section 76 is controlled in unison to rotate or orient a web roll R loaded onto that section so that its prepared leading edge $W_1$ and the strip of double-faced adhesive tape T are at the correct position for splicing, i.e. directly opposite the running web W as shown in FIG. 4. In the present system, this is accomplished by providing an optical sensor 99 (FIG. 3) in splicer 14 to sense the reflective strips S marking the leading edge of the web on roll R. The output of sensor 99 is applied to controller 52 which thereupon controls motor 97 to position the strips S (and tape T) as shown in FIG. 4 so that they are directly opposite running web W. At the same time, the running web roll at roll support section 74 is swung around to position it at the lower position in the splicer formerly occupied by roll support section 76. As best seen in FIG. 3, a pair of lateral rollers 106 are rotatively mounted to brackets 108 projecting out from the opposite ends of arms 72. When the turret 62 is rotated thusly, the web W from that running roll now extends from the roll around a guide roller 106 to guide roller 96 as shown in phantom in FIG. 4**.

Still referring to FIG. 4, when the expiring roll R at the now lower support section 74 reaches a selected minimum diameter, controller 52 initiates a splice sequence. In accordance with this sequence, eddy current brakes 110 (FIGS. 1 and 4) mounted to the carriage extensions **86*a* and coupled to the chucks 86*b* are actuated to brake the depleted roll R at section 74 to a stop or to a selected minimum speed suitable for splicing. The web consuming machine continues to draw its web requirements from the supply stored in festoon 66. The angular velocity of chucks 86*b* and therefore of the running roll R is monitored by suitable means such as by a tachometer (not shown) coupled to a chuck 86*b* and this information is applied to controller 52 or to the splicer controller. When that angular velocity reaches zero or the selected minimum speed, a splicing mechanism shown generally at 112** is actuated.

In the illustrated splicer 14, the splicing mechanism 112 comprises a lateral box-like housing 114 supported at its opposite ends by a pair of arms 116 which extend up to pivotal connections 118 to the splicer side frames 64 at the top thereof. Each arm 116 has a segment **116*a* which extends above its pivotal connection 118 and the rod 118*a* of a double-acting piston 118 is pivotally connected at 122 to the upper end of each extension 116*a*. Each piston cylinder 118*b* is likewise pivotally connected to an ear 126 mounted to the adjacent side frame 64 or to the festoon 66 as shown. The pistons are operated in unison to swing housing 114 between a retracted or out of the way position shown in FIG. 3 and a splicing position shown in FIG. 4. Normally, the housing reposes in its FIG. 3** retracted position.

As best seen in FIG. 3, housing 114 supports a pair of spaced-apart parallel upper and lower web guide rollers 132 and 134, as well as a somewhat larger diameter pressure roller 136 positioned in parallelism between those two guide rollers. Also, a horizontally extending knife assembly 142 is mounted to the lower end of housing 114 opposite guide roller 134.

After the roll of running web at roll support section 74 at the lower end of arms 72 has been braked to a stop or to the selected minimum speed, controller 52 actuates the piston 118 to swing the splicing assembly 112 to its position shown in solid lines in FIG. 4 so that the running web W is guided by the rollers 132 and 134 on housing 114 into engagement with the still stationary roll R supported at the roll support section 76. As noted previously, that fresh web roll has been oriented to position its already prepared leading edge $W_1$ correctly, i.e. so that it will be directly opposite the engaging housing 114. As shown in FIG. 4, the positioning of the splicing assembly 112 in its splicing position locates the knife assembly 142 directly opposite the running web W slightly upstream from housing 114.

Next, controller 52 actuates the pressure roller 136 to momentarily press the running web W against the double-faced adhesive tape T at the leading edge of the stationary roll R at roll support section 76 thereby effecting the splice. Immediately thereafter, controller 52 actuates the knife assembly 142 to cause the knife blade **142*a* to sever the running web W just behind or upstream from the splice. Then the controller 52 actuates piston 118 to swing the splicing mechanism 112 back to its retracted position shown in FIG. 3. Simultaneously, the controller actuates the chuck motors 97 to accelerate the fresh roll R at roll support section 76**.

Preferably, the splicer section 14 includes additional means for accelerating the fresh web roll after a splice has been made so that the web from that roll can be brought up to a speed sufficient to refill accumulator 66 as quickly as possible. This will minimize the required size of the accumulator 66 and therefore the amount of floor area occupied by the splicing apparatus as a whole. In the illustrated splicer section 14, the additional accelerating means is a belt accelerator shown generally at 143 in FIG. 4. As seen there, assembly 143 is suspended between the splicer side frames 64 at the tops thereof. The accelerator comprises a pair of horizontal rollers 144 and 145 around which is stretched an endless belt 145. The former roller connected to the shaft **147*a* of a motor 147 mounted to one of the side frames 64, the motor being controlled by controller 52. The opposite ends of roller 144 are rotatively mounted to the splicer side frames 64. The opposite ends of roller 145, on the other hand, are mounted to corresponding first ends of a pair of arms 142 whose opposite ends are connected by a shaft 144 rotatively mounted to side frames 64. Roller 145 is swingable on arms 142 between an inactive position shown in phantom in FIG. 4 which positions the lower stretch of belt 146 away from the periphery of the roll R supported at the upper position of turret 62 and an active or engaged position shown in solid lines in that same figure which positions the lower stretch of belt 146 in frictional contact with the periphery of that roll. Roller 145 is swung between its two positions by a rotary solenoid 148 mounted to one of the splicer side frames 64 with its shaft rotatively coupled to shaft 144. Controller 52 operates motor 147 to rotate belt 146 in the direction shown by the arrow in FIG. 4 until the surface speed of the new roll (which is initially the same as the speed of the web leaving that roll) reaches a value in excess of the web line speed that will replenish the web accumulator 66 with web within a desired minimum time. Next, controller 52 turns off motor 147 and actuates solenoid 149*a* to shift roller 145 to its position shown in phantom in FIG. 4 so that the accelerator 143 is no longer active. At this point, the splice sequence is completed and the downstream web consuming means now draws its web requirements from the roll R at roll support section 76**.

Referring now to FIG. 3, the web accumulator or festoon 66 can be of any conventional type. Generally, the accumulator 66 comprises a lower set of fixed rollers 150 and an upper set of dancer rollers 152 mounted to a carriage 154 that is movable up and down within the accumulator. Means (not shown) are provided for biasing the carriage 154 away from the set of fixed rolls 150. Web from splicer 14 is looped up and down between rollers 150 and 152 on its way to the web consuming machine. Thus a large length of web can be stored in the accumulator to meet the requirements of the downstream web consuming machine while the running web W is stopped to make a splice. The accumulator 66 also allows web tension control.

Once the new roll R has been mounted to the roll support section 76 and lifted from the guided vehicle 16, that vehicle can be returned to the roll preparation area for re-use. The return of the vehicle 16 to the roll preparation area can be initiated by sensing the removal of the roll from the vehicle using conventional pressure sensors (not shown) mounted to the vehicle or by sensing some operation of the splicer 14 that follows the mounting of that roll to the splicer turret 62. For example, controller 52 can initiate return of the guided vehicle when the turret 62 rotates to position a new web roll at the splicing position shown in FIG. 4. As soon as that empty vehicle 16 has returned to the roll preparation area, another similar vehicle 16 carrying a fresh web roll R may be dispatched to the splicer 14 or that new roll can be loaded onto the same vehicle 16. In either event, controller 52 controls the vehicle 16 so that the new roll will arrive at splicer 14 well before the running roll at the roll support section 76 is due to expire so that the new roll can be loaded into roll support section 74 of the turret 62 in time for the next splice sequence.

In the above example, it was assumed that when the roll R from vehicle 16 was loaded into the roll support section 76 in FIG. 3, that section was empty. In practice, however, except when loading of the first roll into the splicer, that section usually carries the spent core C of the web roll R previously supported by that section. Therefore, before a new roll can be loaded into the section, the spent core must be removed. This removal of the spent core may be accomplished at the same time that the chuck support members 86 are spread apart by motor 84 in preparation for receiving a new web roll R from vehicle 16. In other words, when the members 86 are spread apart, their chucks **86*b* will disengage from the ends of the spent core C allowing the core to drop to the floor or, more preferably, into one of the trays 154 mounted to the opposite sides of vehicle 16 as shown in phantom in FIG. 3**.

For most applications, however, this removal by gravity of the spent core C is not reliable enough. Also, the spent core invariably carries a tail consisting of the stretch of running web W between the expiring roll R and the knife assembly 142 after a splice is made as aforesaid. This web tail should be wound up on the core C before the core is released from the roll support section 74, 76. Accordingly, splicer 14 is provided with a core removal assembly 160 shown in FIG. 3 and in detail in FIG. 5. Assembly 160 comprises an arm 162 connected at one end by a pivot 164 to ears 166 projecting forwardly from accumulator 66. The free end of arm 162 is provided with an upstanding tab or wall 168 which forms one member of a clamp. The other clamp member is an upstanding tab 172 which is part of a slider 174 keyed into a lengthwise channel or groove 176 in the top of arm 162. Slider 174 and its tab 172 are moved toward and away from tab 168 by a piston 178 acting between the opposing end walls of channel 176 and slider 174, the piston being under the control of controller 52.

Arm 162 is movable between a lower position shown in phantom in FIG. 3 which places the arm below the level of the trays 154 carried by vehicle 16 and a raised position shown in solid lines in FIG. 3 which places the clamp tabs 168 and 172 at substantially the same elevation as a roll core C at the lower support position on turret 62 when the turret is in its position shown in FIG. 3. Arm 162 is moved between its two positions by a piston 182 whose cylinder **182*a* has its end connected by a pivot 184 to the ears 166 of accumulator 66 near the bottom thereof and whose rod 182*b* is connected by a pivot 188 to arm 162. Piston 182 is also controlled by controller 52**.

Arm 162 normally reposes in its lower stowed position shown in phantom in FIG. 3. Immediately after the conclusion of the splice sequence described above, and while vehicle 16 is still at the loading station 24, controller 52 actuates piston 182 to raise arm 162 to its solid line position shown in FIG. 3 so that the clamp tabs 168 and 172 bracket the core C supported in the lower turret position. Then, controller 52 actuates piston 178 to cause the slider 174 and its tab 172 to move toward clamp tab 168 thereby firmly gripping the core C. Next, the controller 52 actuates the motors 84 on splicer section 14 to spread apart the chuck support members 86 as described previously thereby releasing core C from the lower splicer section of turret 62. Next, controller 52 activates piston 182 to lower arm 162 thereby returning the arm to its stowed position. When the arm reaches the level of the vehicle tray 154 in front of the splicer 14, controller 52 actuates piston 178 to retract slider 174 thereby releasing the roll core C. A slot **154*a* is provided in each tray 154 to provide clearance for the arm so that when the arm swings through the slot and below the tray, the spent core C carried by the arm is deposited in the tray 154. Thus the expired roll core C will be carried away from the splicer 14 when the vehicle 16 returns to the web preparation area to receive a fresh roll R. As shown in FIG. 3, trays 154 are mounted on both sides of vehicle 16 so that the vehicle can approach a splicer 14** from either direction.

Figure 5:
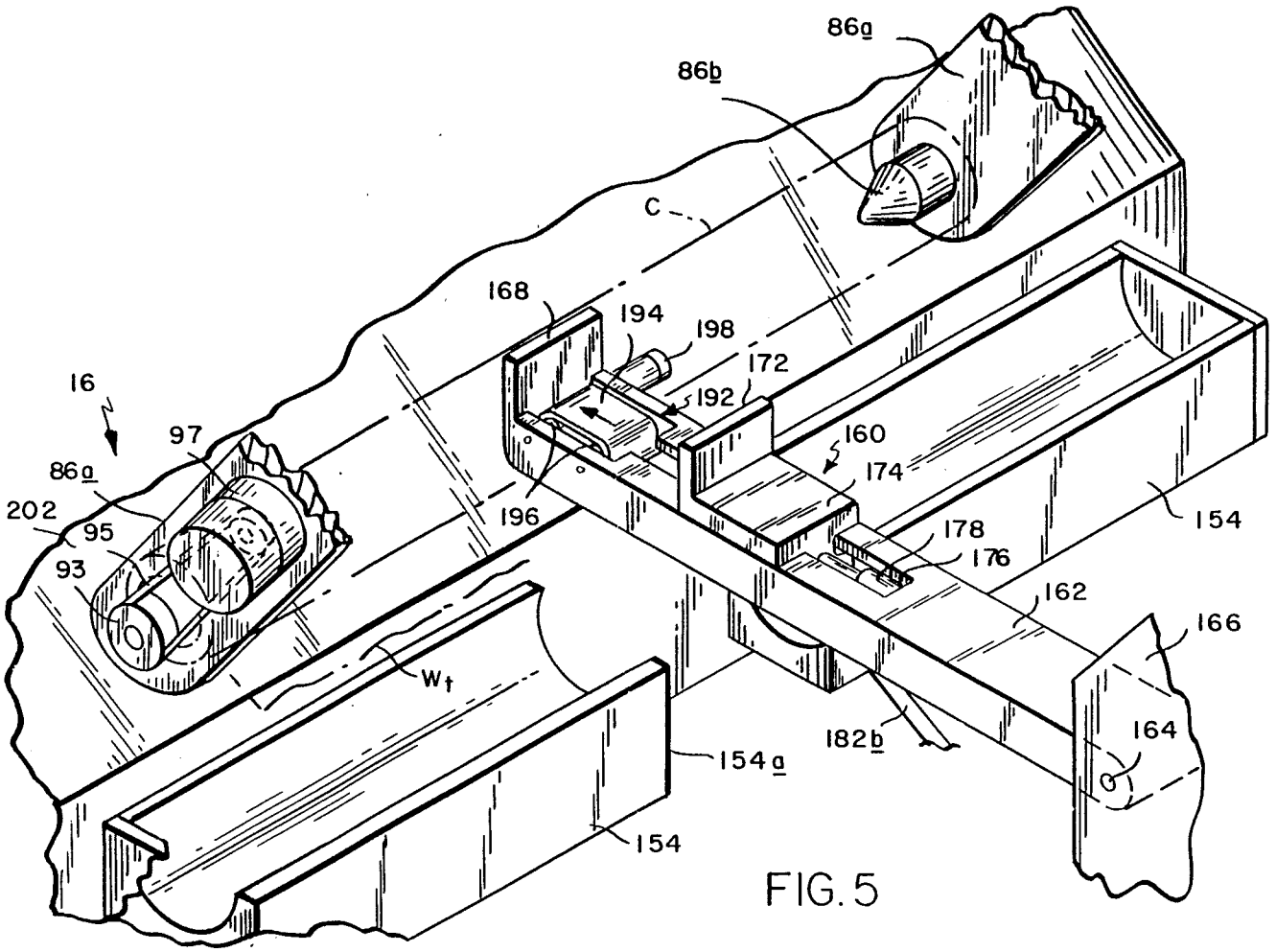
FIG. 5 is an isometric view on a larger scale showing a portion of the splicer section in greater detail.

Referring to FIG. 5, to facilitate the removal of a spent roll core C even though a web tail $W_t$ is still attached to the core, a preferred embodiment of splicer 14 includes provision for winding up that tail on the spent core C before the core is removed from the splicer turret 62. In the illustrated splicer, this core winding means comprises a belt assembly shown generally at 192 in FIG. 5 mounted in a top recess 193 in arm 162 between tabs 168 and 172. Basically, assembly 192 is an endless belt 194 trained around rollers 196 rotatively mounted in the side walls of arm recess 193, one of the rollers 196 being rotated by the shaft of an electric motor 198 mounted to the side of arm 162. The upper stretch of belt 196 projects up into the space between the clamp tabs 168 and 172 and the belt is moved in the direction of the arrow in FIG. 5 by motor 198 under the command of controller 52. Just before the spent core is clamped between tabs 168 and 172 as described above, motor 198 is turned on momentarily by the controller so as to rotate the spent core C clockwise as viewed in FIGS. 3 and 5 so as to wind up the tail $W_t$ on the spent core C.

As an alternative, the chuck drive motor 97 of splicer section 76 may be activated by controller 52 to roll up the tail $W_t$ on the core before that core is passed off by the roll support section 74 or 76 to the clamping arm 162. In that event, the piston 178 on the arm may be replaced by a simple spring that urges slider 174 toward the clamp tab 178 and a stop to limit the minimum spacing between the clamp tabs 168 and 172 to a Value someWhat less than the diameter of roll core C (with its tail $W_t$). Thus, when arm 162 is moved to its upper position to engage the spent core C, the core will wedge apart the two clamp tabs 168 and 172 and those tabs will resiliently clamp the roll core. Then when the arm is moved to its lower stowed position, the passage of the arm down through the slot 154*a* in tray 154 will dislodge core C from between the clamp tabs leaving the core in the tray.

Figure 6:
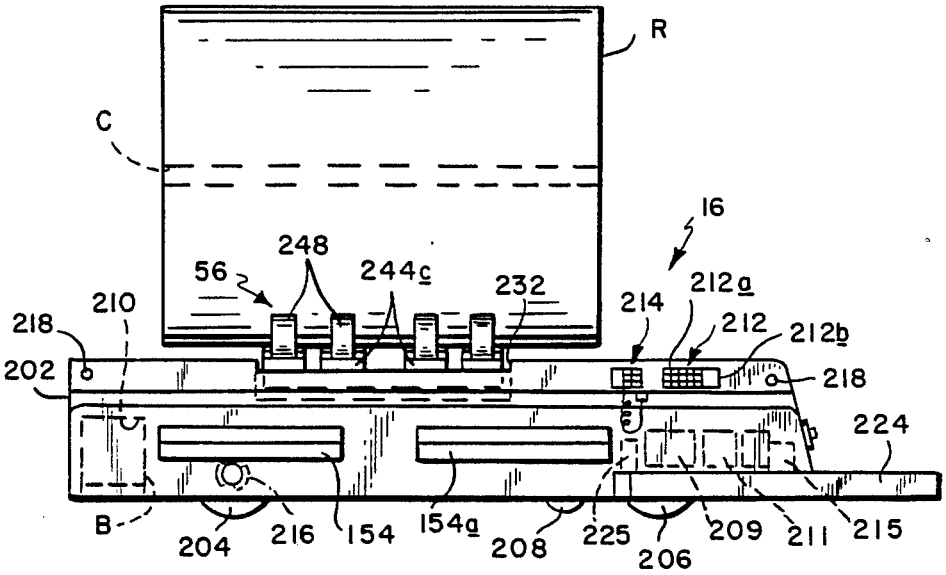
FIG. 6 is a scale view on a slightly larger then FIG. 4 showing the guided vehicle section of the system in greater detail.

Referring now to FIGS. 2 and 6, the automatic guided vehicle 16 is essentially a robotic cart which bears some similarity to existing conventional guided vehicles of this same general type. It does, however, have certain important differences and features which contribute significantly to the success of the present system. Vehicle 16 comprises a housing or body 202 which rolls along the ground on three wheels, namely, a pair of laterally spaced-apart rear follower wheels 204 and a single centrally located steerable and driven front wheel 206. Also, a pair of spaced-apart swivel casters 208 are provided just art of front wheel 206 to prevent the vehicle from tipping to any great degree. The diameters and rotary axes of the casters are arranged so that the casters normally do not touch the ground. That is, one or another of the casters becomes active only when the vehicle tips in the order of 10° in the direction of that caster.

The vehicle front wheel 206 is driven by a suitable dc electric motor 209 on the vehicle 16, the energy for the motor being provided by a rechargeable battery B mounted in a recess 210 at the rear of the vehicle as shown in FIG. 6. A suitable battery B is a 36 volt, 200 amp. rechargeable battery. Such a battery is able to run the vehicle 16 for about 18 hours in a production environment, although preferably the battery should be recharged every 12 hours.

The front wheel 206 is turned in order to steer the vehicle by any appropriate steering mechanism 211. Since the steering arrangement and the mechanisms for causing the vehicle to follow the wire paths $P_0$ to $P_5$ embedded in the floor of the facility are not part of this invention, they will not be described here. Basically, any conventional guidance mechanism may be used which senses the embedded wire and responds to embedded magnetic codes along the wire paths.

A control panel 212 is provided on the side of the vehicle as shown in FIG. 6. Basically, this panel comprises a keypad 212*a* by which an operator may key in instructions to a vehicle control section 215 to cause the vehicle to perform certain functions or to program controller 52. Panel 212 also includes a display 212*b* for displaying the keyed-in instructions, diagnostics and information such as vehicle destination, instruction changes, etc. Also, a hand-held control unit 214 is hooked onto the side of the vehicle as shown in FIG. 6 so that an operator walking alongside can control the vehicle manually when it is not following the embedded wire paths $P_0$ to $P_5$.

Vehicle 16 also includes electric brakes 216 for the rear wheels 204 as shown in FIG. 6. These brakes are activated by controller 52 when the vehicle is to be brought to a stop at a selected location such as loading station 22 or 24. The brakes can also be activated by depression of emergency stop buttons 218 present at the four corners of the vehicle housing 202. Depression of any of these buttons also electrically isolates the battery B from the drive motor 209.

The vehicle 16 further includes provision for minimizing the likelihood of the vehicle 16 striking a person or a large object in the path of the vehicle. More particularly, a lateral array of ultrasonic sensors 222 are provided on the front of the vehicle housing 202 as shown in FIG. 2. Each sensor has a fairly narrow beam so that the array as a whole is able to detect any intercepted object in the path of the vehicle and apply a corresponding signal to the controller. The controller will thereupon de-energize the drive motor 209 and actuate the brakes 216.

An additional measure of safety is provided by a sensing bumper 224 which projects out a substantial distance in front of the vehicle body 202; it also projects laterally beyond the vehicle trays 154. Preferably, the bumper clears the floor of the facility by a few inches so that it is not engaged by small boards or other objects that may be on the floor of the facility in the path of the vehicle. Bumper 224 is arranged to actuate a switch 225 (FIG. 6) which disables the vehicle drive motor 209 and actuates brakes 216. The bumper projects out far enough in front of the vehicle so that when the bumper engages a person or other object, the power to the drive motor is cut off and the vehicle is braked to a stop in the time that it takes the vehicle to move at its full rate of speed, i.e. about 200 ft. per minute, over the distance between the front of bumper 224 and the front of the vehicle body 202. In other words, when the bumper engages an obstacle, the vehicle is stopped before the front of the vehicle body can strike that obstacle.

Figure 7:
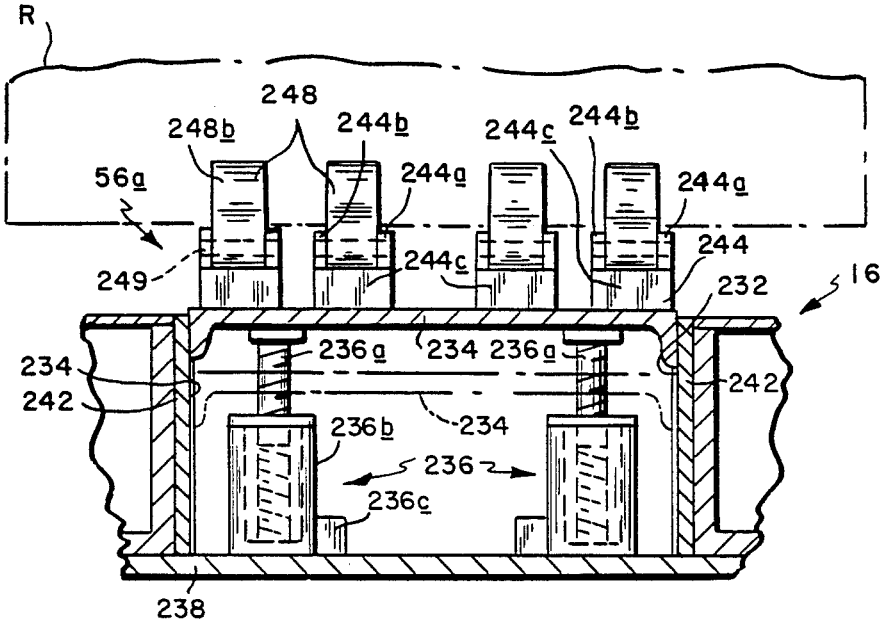
FIG. 7 is a fragmentary sectional view on a larger scale showing certain internal parts of the FIG. 6 vehicle section in greater detail.

Referring to FIGS. 2, 6 and 7, an important feature of vehicle 16 is the special lift table 5 described previously which lifts up to supportively engage a roll R suspended above loading station 32 without changing the position of the roll centerline or of core C. Table 56 is actually split lengthwise and comprises two individually controllable mirror image sections 56*a* and 56*b* which are mounted in a rectangular recess 232 in the top of the vehicle body 202. Each section 56*a*, 56*b* comprises a horizontal platform 234 which is supported from below by a pair of front and rear ball screw jacks 236. The telescoping component 236*a* of each ball screw jack engages the underside of platform 234 and the fixed component 236*b* of the ball screw jack is supported on a suitable horizontal frame member 238 in the vehicle. Each ball screw jack is actuated by an associated electric motor 236*c* under the control of the vehicle's control section 215 or controller 52. The platform 234 of each lift table section 56*a*, 56*b* may be moved by its ball screw jack 236 between a lower position shown in phantom in FIG. 7 and a raised position shown in solid lines in that figure, the distance between the two positions being in the order of 1 ft. Preferably, means such as linear bearings 242 are provided to limit the movement of each platform 234 to strictly vertical movement when the lift table 56 is under load. Preferably, also, means are provided for discouraging the two table sections 56*a* and 56*b* from spreading apart laterally when the table is under load. Such means may include, for example, relatively stiff springs connected between corresponding parts of the two table sections, e.g. platforms 234.

Still referring to FIGS. 2 and 7, since the table sections 56*a* and 56*b* are substantially identical, we will describe only the former section in detail. Mounted to the top of each platform 234 is a lengthwise series of generally U-shaped yokes 244. Each yoke comprises front and rear walls 244*a* and 244*b* and a single outside wall 244*c* which is somewhat shorter than the front and rear walls and has a horizontal upper edge. Positioned in each yoke 244 is a generally upwardly curved or arcuate roll support member 248 which is about 20 inches long. Each member 248 is connected by a pivot 249 to the front and rear walls of the yoke so that the member is able to swing about an axis that is generally parallel to the longitudinal axis of the vehicle 16, with the outward tilt of each member 248 being limited by engagement with the corresponding yoke sidewall 244c.

The support members 248 and their yokes 244 of each table section 56a, 56b are substantially identical except that the pivots 249 of the two innermost members 248 of each section are about ⅛ inch lower than the pivots of the two outermost members 248 of that section. Thus, when vehicle 16 is supporting a relatively long web roll R, the weight of the roll is carried by the endmost support members 248 of each table section 56a, 56b. On the other hand, when the vehicle is supporting a web roll that is shorter than the distance between the endmost support members 248 of each table section 56a, 56b, the weight of the roll is borne by the two innermost support members 248 of each table section. In other words, a total of only four support members 248 on the lift table are used at any given time to support the web roll.

When loading a roll R onto vehicle 16 at loading station 22, the vehicle is positioned at the loading station 22 under roll R as described above with its lift table 56 being in its lower position shown in phantom in FIG. 7. The system controller is programmed to energize the ball screw jack motors 236c of each table section 56a, 56b independently thereby raising each table section toward their solid line positions shown in FIG. 7. As described above, the lift 12 positions the web roll R at the same elevation above the floor that the splicer chucks 86b have when the splicer turret 62 is positioned to pickup a new roll as shown in phantom in FIG. 4. In a typical example, the roll R would be positioned about 50 inches above the floor which would typically place the roll about 1 ½ inches above the lift table 56 of the vehicle 16 at loading station 22.

The two table sections 56a, and 56b are lifted independently so that the support members 248 of each section engage under the roll R at each side thereof. As shown in FIG. 2, each member 248 has a lower inner end 248a which first engages the bottom of roll R. That engagement causes the member to pivot so as to swing its upper outer end 248b against the adjacent side of the roll so that the roll is captured between the two sets of support members 248 on the two table sections. Each table section 56a and 56b continues to be raised independently until the two sections together assume the complete weight of the roll R that weight being in the order of 6,000 lbs. The current of each ball jack motor 236c is monitored and when that current reaches a predetermined value indicating a selected torque limit, motor is stopped. Thus that the two table sections 56a and 56b can, in fact, be raised to slightly different heights in order to support the roll R so that the roll centerline and its core C remain at exactly the same location when the roll is passed off by the lift 22 to the vehicle 16. As noted previously, this assures that the centerline and core C of each successive web roll R will be located at precisely the same position when its weight is assumed by the vehicle 16, even though the different rolls may have different eccentricities, tapers, weights, etc. Resultantly, each of these rolls, when transported by vehicle 16 to splicer 14, will be at precisely the proper position at loading station 24 to be picked up automatically by the arms of the splicer turret 62.

When the roll R is deposited on vehicle 16 and is captured by the roll support members 248 on that vehicle, the roll is extremely stable. In fact it takes in the order of 1700 lbs. to move the centerline of the roll from its set position on vehicle 16. Therefore, even if the vehicle goes over a small bump on its way to a splicer 14, the roll will not shift with respect to the vehicle 16 so as to upset the position of the roll centerline.

It will thus be seen from the foregoing that the system described herein greatly facilitates the handling of large and heavy web rolls. The system permits full web rolls to be prepared at a single web preparation area and be transported automatically to any one of a number of different web splicers and be loaded onto those splicers and spliced to the trailing ends of expiring webs in those splicers without any human intervention whatsoever. Furthermore, the system even removes the spent cores from those splicers and deposits them in the guided vehicles which thereupon transport the cores away from the work area.

It will thus be seen that the objects set forth above, among those made apparent from the preceding description are efficiently attained. Also, certain changes may be made in the above construction without departing from the scope of the invention. For example, instead of using a single controller 52 to control the system, the individual systems 12, 14 and 16 may each have associated controllers which share the control functions and perform those that are unique to that section. In other words, the controller 52 may be programmed to instruct separate controllers in sections 12, 14 and 16 to initiate preprogrammed routines that cause those sections to carry out their allotted functions. Therefore, it is intended that all of the subject matter contained in the above description or shown in the accompanying drawings shall be interpreted as illustrative and not in a limiting sense.

Having described our invention, what is claimed as new and desired to be secured by a patent are defined in the following claims:

We claim:

1. A web roll handling system comprising a roll loading section, a plurality of splicers and at least one robotic vehicle arranged to travel back and forth along a floor between the loading section and the plurality of splicers, each splicer having a roll supporting turret with arms carrying roll chucks, said turret being movable to position the chucks at a selected elevation above the floor to pick up a web roll from said at least one vehicle when that vehicle travels to that splicer, said loading section including means for loading a roll onto said at least one vehicle, said at least one vehicle including a lift table for engaging a web roll from below and supporting the roll centerline at the same elevation above the floor, as the elevation above the floor of the splicer roll chucks when they are positioned to pick up a web roll from said at least one vehicle.

2. The system defined in claim 1 wherein the loading section includes an inclined rail supported above the floor, an upper end segment of which is positioned to overhang said at least one vehicle when that vehicle travels to the loading section; roll chucks on said loading means for engaging a web roll, and means for moving the carriage along the inclined rail so as to lift a web roll engaged by said chucks from a position close to the floor to said same elevation above the floor.

3. The system defined in claim 1 wherein said loading section includes an inclined rail supported above the floor, an upper end segment of which is positioned to overhang said at least one vehicle when that vehicle travels to the loading section; roll chucks on said loading means for engaging a web roll, and means for moving the loading means along the inclined rail.

4. The system defined in claim 1 wherein each splicer includes a frame; a web accumulator, a turret pivotally mounted to said frame, said turret including a shaft rotatively mounted to the frame for rotation about a horizontal axis; a pair of spaced apart arms mounted intermediate their ends to said shaft;

means for rotating said arms about said axis;

pairs of cooperating roll chucks positioned at opposite ends of said arms, and means for mounting the chucks of each said chuck pair to said arms for movement toward and away from one another.

5. The system defined in claim 4 where each said chuck mounting means include at least one guide shaft connected between said arms; lead screw means rotatively mounted to said arms; chuck-supporting plates slidable on the guide shaft and threadedly receiving the lead screw means, and means for rotating the lead screw means.

6. The system defined in claim 1 and further including cooperating means on said at least one vehicle and each of said plurality of splicers for sensing when said at least one vehicle travels to each of said plurality of splicers and emitting a ready signal in response thereto, and means responsive to said ready signal for advancing said at least one vehicle to a roll unloading position in front of said each splicer.

7. The system defined in claim 1 wherein said at least one robotic vehicle includes a frame; said lift table movably mounted to the frame so that the table can move vertically between a lower position and an upper position, and means for moving the table between its two positions.

8. The system defined in claim 7 wherein said lift table is split longitudinally into a pair of independently movable mirror image sections; said table moving means include means for moving each table section independent of the other, and load sensing means on each vehicle for controlling the movement of each table section toward its said upper position so that the two sections share equally the weight of a web roll placed on that vehicle.

9. A web roll handling system comprising a roll loading section, a plurality of splicers and at least one robotic vehicle arranged to travel back and forth along a floor between the loading section and the plurality of splicers, each said vehicle including a frame, a lift table movably mounted to the frame, said lift table being split longitudinally into a pair of independently movable mirror image sections, means for moving the table between its two positions, said table moving means including means for moving each table section independently of the other between upper and lower positions, and load sensing means on each vehicle for controlling the movement of each table section toward its said upper position so that the two sections share equally the weight of a web roll placed on that vehicle.

10. The system defined in claim 9 wherein the table includes parallel lengthwise sets of transversely-extending spaced-apart, arcute, roll supporting fingers pivally connected to the remote longitudinal edges of said table sections.

11. The system defined in claim 9 wherein the means for moving each table section include at least one ball screw jack.

* * * * *